US008224002B2

(12) United States Patent
Kornagel

(10) Patent No.: US 8,224,002 B2
(45) Date of Patent: Jul. 17, 2012

(54) METHOD FOR THE SEMI-AUTOMATIC ADJUSTMENT OF A HEARING DEVICE, AND A CORRESPONDING HEARING DEVICE

(75) Inventor: Ulrich Kornagel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1328 days.

(21) Appl. No.: 11/904,582

(22) Filed: Sep. 27, 2007

(65) Prior Publication Data

US 2008/0112583 A1 May 15, 2008

(30) Foreign Application Priority Data

Sep. 29, 2006 (DE) ..... 10 2006 046 316

(51) Int. Cl.
*H04R 25/00* (2006.01)

(52) U.S. Cl. ..... 381/312; 381/317

(58) Field of Classification Search ..... 381/312, 381/317

See application file for complete search history.

(56) References Cited

U.S. PATENT DOCUMENTS 6,035,050 A 3/2000 Weinfurtner et al.
6,748,089 B1 * 6/2004 Harris et al. ..... 381/107
2005/0129262 A1 * 6/2005 Dillon et al. ..... 381/312
2005/0281424 A1 12/2005 Rass

FOREIGN PATENT DOCUMENTS

DE 102004025691 B3 8/2005
EP 0814634 A1 12/1997
EP 1432282 A2 6/2004

* cited by examiner

*Primary Examiner* — David Vu
*Assistant Examiner* — Brandon Fox

(57) ABSTRACT

The object is to take better account of subjective perceptions when setting a hearing device or a communication system, especially a hearing aid. Therefore, an automatic setting of the hearing device by automatically analyzing the hearing situation in which the hearing device is located, and automatic setting of a parameter of the signal processing device of the hearing device relative to the hearing situation in a first parameter range is provided. In addition, manual setting of the parameter of the signal processing device to a value in a second parameter range outside the first parameter range takes place, with the automatic setting in the first parameter range being ended by this. With this semi-automatic control, the user can find an individual compromise between effectiveness and artifacts of a signal processing.

12 Claims, 2 Drawing Sheets

METHOD FOR THE SEMI-AUTOMATIC ADJUSTMENT OF A HEARING DEVICE, AND A CORRESPONDING HEARING DEVICE

CROSS REFERENCE TO RELATED APPLICATIONS

This application claims priority of German application No. 10 2006 046 316.1 filed Sep. 29, 2006, which is incorporated by reference herein in its entirety.

FIELD OF THE INVENTION

This invention relates to a method for adjusting a hearing device by the automatic analysis of a hearing situation in which the hearing device is located and an automatic adjustment of the parameter of the signal processing device of the hearing device relative to the hearing situation in a first parameter range. Furthermore, this invention relates to a corresponding hearing device with analyzing and adjusting facilities of that kind. The term hearing device in this case particularly includes a hearing aid. The definition also includes any other communication systems of a portable or non-portable kind, in which hearing plays an essential role, such as headsets and headphones.

BACKGROUND OF THE INVENTION

Hearing aids are portable hearing devices used to treat the hearing impaired. To cater for the numerous individual needs, different types of hearing aids, such as behind-the-ear (BTE), in-the-ear (ITE) and concha hearing aids are provided. These examples of hearing aids are worn on the external ear or in the auditory canal. Furthermore, there are also bone-conduction hearing aids, implantable or vibrotactile hearing aids available on the market. In this case, the damaged hearing is stimulated either mechanically or electrically.

In principle, hearing aids have an input converter, an amplifier and an output converter as the main components. The input converter is usually a sound receiver, e.g. a microphone and/or an electromagnetic receiver, e.g. an induction coil. The output converter is usually realized as an electroacoustic converter, e.g. a miniature loudspeaker, or as an electromechanical converter, e.g. bone-conduction hearing device. The amplifier is usually integrated into a signal processing unit. This type of design is shown in FIG. 1 using a behind-the-ear hearing aid as an example. One or more microphones 2 to record the sound from the environment is/are built into a hearing aid housing 1 for wearing behind the ear. A signal processing unit 3, which is also integrated into the hearing aid housing 1, processes and amplifies the microphone signals. The output signal of the signal processing unit 3 is transmitted to a loudspeaker or a hearing device 4 that outputs an acoustic signal. The sound is also sometimes transmitted via a sound tube, fixed in the auditory canal by an otoplastic, to the eardrum of the aid wearer. The power supply of the hearing aid, and particularly that of the signal processing unit 3, is provided by a battery 5 which is also integrated into the hearing aid housing 1.

Communication systems in general, not just hearing aids, should if possible operate adapted to the situation. In an environment subject to unwanted noise a noise reduction algorithm, for example, should be automatically activated.

In principle, the algorithm to improve the sound or the intelligibility of speech, or to ensure a system behavior (e.g. feedback compensator) is activated only to the extent, and takes effect only at strength, required by the situation because the algorithms can also exhibit disadvantageous behavior. The negative effects should never outweigh the positive.

For example, a noise reduction algorithm, a directional microphone or a feedback compensator (in the sub-critical case) should not be activated if the hearing aid wearer is at a concert. In this situation, a noise reduction algorithm would attack the useful signal and generate artifacts. A directional microphone would cause undesirable changes to the spatial sound. A feedback compensator would generate undesirable artifacts.

Furthermore, there are situations in which these algorithms are activated but should only have a weak effect. If such system parameter adjustments are to be applied to enable the hearing aid to have the maximum acceptance, this can only be achieved by an individual decision by the hearing aid wearer.

In previously known systems, either mid parameter settings were provided that represented a compromise, or classifications were provided that meant decisions were made on the basis of objective features and the system was correspondingly controlled. The subjective perception is then no longer taken into account in the normal operating phase.

A programmable hearing aid system for determining optimum parameter sets for a hearing aid is known from publication EP 0 814 634 A1. In addition to the hearing aid itself, the hearing aid system has an adapter device that essentially has a first memory for several selectable parameter sets for each of several hearing situations and an input device to select an actual existing hearing situation as well as one of the many parameter sets available for selection for this hearing situation. Furthermore, it has a second memory for assignment data applicable to the parameter sets selected for each hearing situation. To determine an optimum parameter set in each case for several hearing situations, it is essentially proposed that during an optimization phase a user-specific optimum parameter set be assigned to each actual hearing situation that occurs and the determined assignment data for determining an optimum parameter set for each hearing situation be selected after the optimization phase.

Furthermore, a hearing aid with a control device is known from patent application DE 10 2004 025 691 B3. The acoustic hearing environment in which the hearing aid is located is analyzed and an adjustment function depending on the actual hearing situation is assigned to at least one control element depending on the detected hearing situation. The adjustment possibility of the hearing aid is thus limited to the adjustment possibilities appropriate for the actual hearing situation.

From publication EP 1 432 282 A2, a method is known for adapting a hearing aid to a momentary acoustic environmental situation and also a corresponding hearing aid system. A parameter set belonging to the ambient situation is stored in the hearing aid. The parameters of the set parameter set can be adjusted according to the hearing wishes of the hearing aid wearer by means of an input part that can be operated by the hearing aid wearer.

SUMMARY OF THE INVENTION

The object of this invention is to better take account of the subjective perception when adjusting the hearing aid.

According to the invention, a method is provided for adjusting a hearing device by automatically analyzing a hearing situation in which the hearing device is located and for the automatic setting of a parameter of the signal processing device of the hearing device in a first parameter range depending on the hearing situation, and also manual setting of the parameter of the signal processing unit to a value in a second parameter range outside the first parameter range, with the automatic setting in the first parameter range being ended by this, with an acceptance or perceptibility threshold for an artifact being specified during the signal processing for the automatic setting of the first parameter range being specified so that the artifact lies below the acceptance or perceptibility threshold and in the second parameter range the artifact lies above the acceptance or perceptibility threshold.

Furthermore, according to the invention a hearing device with a signal processing device, an analyzing device for the automatic analysis of a hearing situation in which the hearing device is located, and an adjusting device for the automatic setting of a parameter of the signal processing device relative to an analyzed hearing situation in a first parameter range in which an artifact of the signal processing of the signal processing device lies below a specified acceptance or perceptibility threshold is provided, with the adjusting device being designed to manually set the parameter of the signal processing device to a value in a second parameter range outside the first parameter range, and with the artifact lying in the second parameter range above the acceptance or perceptibility threshold.

Furthermore, according to the invention a hearing device with a signal processing device, an analyzing device for automatically analyzing a hearing situation in which the hearing device is located, and an adjusting device for the automatic setting of a parameter of the signal processing device relative to the analyzed hearing situation in a first parameter range is provided, with the adjusting device being designed for the manual setting of the parameter of the signal processing device to a value in a second parameter range outside the first parameter range.

The control of the hearing device or communication system thus takes place semi-automatically in an advantageous manner. The effective strength of the performance features of the hearing device can thus be individually matched to each time point with the subjective impressions being better allowed for. The full effective bandwidth of the algorithm can thus be exploited, which otherwise would not be possible because of the increasing necessity of a compromise setting of the parameters. In particular the manual setting enables artifacts to be allowed for under certain circumstances, but the particular algorithm is operated at a higher strength compared with the automatic setting range.

It is preferable if the value in the second parameter range can also be changed. This can for example take place manually or steplessly if necessary. Alternatively an automatic setting can also take place in the second parameter range. This enables automatic functions to also be used in a "forbidden" range.

The value in the second parameter range can be permanently stored in the hearing device. It is particularly advantageous if this value is stored as a variable software value in the hearing aid, for example during the initial setting or adjustment. A hearing aid can, for example, be individually adapted in this way.

The value in the second parameter range can also be automatically changed relative to an actual hearing situation. An automatic value setting can thus also take place relative to a classifier decision.

The parameter that is to be set can also itself be automatically selected relative to an actual hearing situation if required. This substantially increases the possibilities for semi-automatic adjustment.

BRIEF DESCRIPTION OF THE DRAWINGS

This invention is explained in more detail with the aid of the accompanying drawings. The drawings are as follows.

DETAILED DESCRIPTION OF THE INVENTION

The exemplary embodiments described in the following represent preferred embodiments of this invention.

Figure 1:
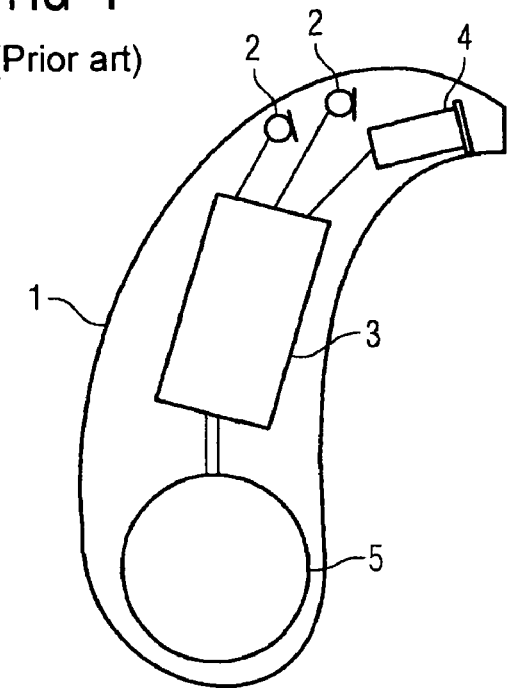
FIG 1 (Prior art)
FIG. 1 A general drawing showing the construction of a hearing aid.
Figure 2:
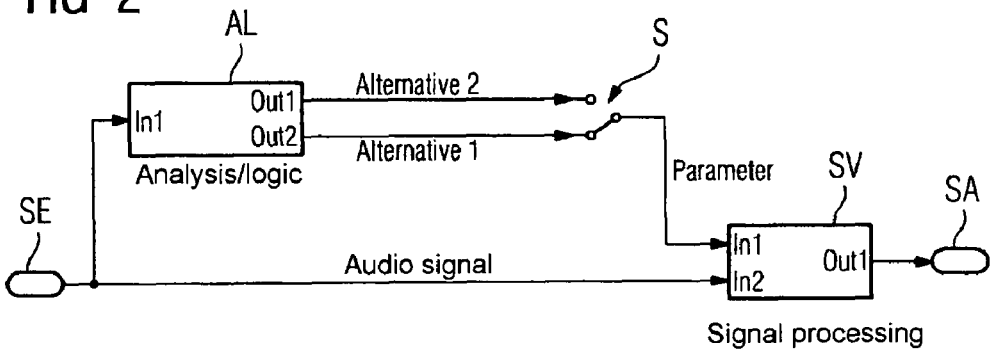
FIG. 2 A block circuit diagram showing the principle of the signal processing of a hearing device according to the invention and FIG. 3 A sketch showing the operation of the inventive method or of the inventive hearing device.

As shown in FIG. 2, the signal is applied to the signal input SE of a signal processing device SV. The output signal of the signal processing device SV is provided at a signal output SA. For semi-automatic setting of the signal processing device SV, an analysis/logic unit AL is used that also picks up the signal from the signal input SE. The analysis logic unit AL provides two output signals: alternative 1 and alternative 2. Both alternatives represent parameters for the control of the signal processing device SV. By means of a manual switch S, the hearing aid wearer or the user of the communication system selects the parameter or particular alternative suitable for him. In the chosen example, the parameter is automatically chosen relative to the respective hearing situation in accordance with alternative 1. This means that the communication system operates at a mid or classifier-controlled setting without a request by the user. If the user is not satisfied with this setting, he can increase the effective strength of the basic algorithm by operating the manual switch S.

Switching to the alternative mode can also take place in that a button is operated, thus switching the system to a selection mode. The required setting is acknowledged by pressing the button again.

Figure 3:
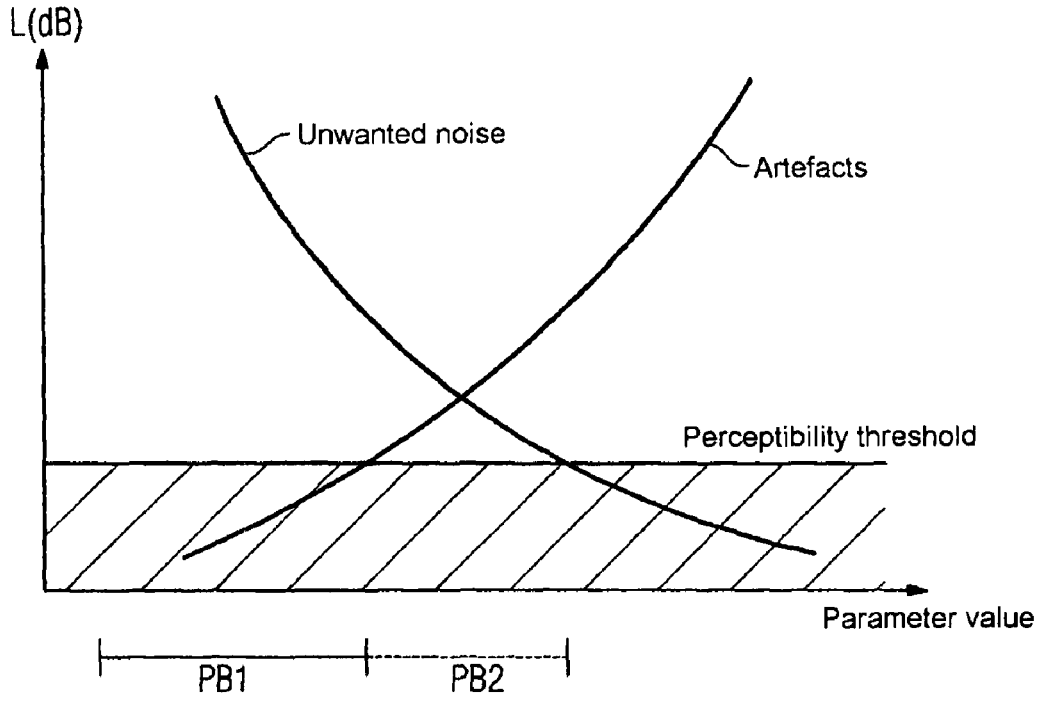

The functioning of the method according to the invention or of the hearing device according to the invention is now further explained with the aid of FIG. 3. In this example, a noise reduction algorithm is to be semi-automatically set. The level of the unwanted noise drops with the increase in the parameter value of the noise suppression algorithm. However, the level of artifacts which result during the increase in the parameter value increases at the same time. The perceptibility threshold below which the noise or artifacts are not audible is also shown in FIG. 3. According to this example, the automatic signal processing is set so that it selects the parameter value from a conventional setting range PB1. The artifacts of the noise suppression algorithm are not perceptible in this range (or acceptable if it is the acceptance threshold).

As the illustration shows, the unwanted noise remaining after the unwanted noise algorithm can be further reduced by further increasing the parameter value of the unwanted noise algorithm. The artifacts are then, however, perceptible and can manifest themselves, for example as a warbling noise that results from the modulation on the useful signal. According to the invention, the user now decides whether the artifacts are acceptable to him and therefore manually selects the parameter range PB2 or a value. He thus takes account of the artifacts and profits from a lower unwanted noise level.

The principle according to the invention can also, for example, also be used in a similar manner for speech intelligibility. Thus, for example, the directional characteristic of a hearing aid can be increased by means of a parameter. However this is accompanied by an increasing loss of the low frequency in the output signal. In an automatic setting range, the directional characteristic can therefore be automatically adjusted only up to a certain degree. The user can now accept the increasing loss of low frequency in favor of a better directional effect. In this case, he would manually choose the additional setting range PB2.

The inventive semi-automatic control thus takes place according to the principle that the system offers at least two alternative settings for one or more performance features of the communication system or hearing device, from which the user actively selects the best one for him. In a simplest case, the device offers two alternative settings, i.e. a "defensive" setting and an "aggressive" setting. The user operates a switch/button and thus acknowledges the alternative preferred by him for the particular hearing situation.

As an extension of the inventive principle, more alternatives of setting ranges or setting values can also be offered. Depending on the control element, at least one parameter in a value range can also be changed, comparable with a volume control. In principle any operator interface can be used as a control element, e.g. button on the device, button on a remote control, wheel for stepless setting etc.

The alternative parameter settings can be either permanently stored in a system or parameter settings adapted to the situation at any timepoint can be determined by an analysis unit in combination with a logic unit. Furthermore, the selection of the performance features relevant to this concept and the selection of parameters for these performance features can be permanently preset or held as user-programmable features.

The invention claimed is:

1. A method for setting a hearing device, comprising:

automatically analyzing a hearing situation in which the hearing device is located;

automatically setting a parameter of a signal processing device of the hearing device relative to the hearing situation to a first value in a first parameter range;

ending the automatic setting in the first parameter range;

setting the parameter of the signal processing device of the hearing device to a second value in a second parameter range outside the first parameter range; and specifying an acceptance or perceptibility threshold of an artifact resulting from the signal processing of the hearing device so that the artifact lies below the threshold in the first parameter range and lies above the threshold in the second parameter range.

2. The method as claimed in claim 1, wherein the parameter of the signal processing device is manually set to the second value in the second parameter range.

3. The method as claimed in claim 1, wherein the second value in the second parameter range is manually changed.

4. The method as claimed in claim 1, wherein the second value in the second parameter range is automatically changed relative to the hearing situation.

5. The method as claimed in claim 1, wherein the second value in the second parameter range is permanently stored in the hearing device.

6. The method as claimed in claim 1, wherein the parameter of the signal processing device is automatically selected relative to the hearing situation.

7. A hearing device, comprising;

a signal processing device that processes a signal of the hearing device;

an analysis device that automatically analyze a hearing situation in which the hearing device is located; and an adjusting device that:

automatically sets a parameter of the signal processing device relative to the hearing situation to a first value in a first parameter range in which an artifact resulting from the signal processing lies below a specified acceptance or perceptibility threshold, and sets the parameter of the signal processing device to a second value in a second parameter range outside the first parameter range in which the artifact lies above the specified acceptance or perceptibility threshold.

8. The hearing device as claimed in claim 7, wherein the parameter of the signal processing device is manually set to the second value in the second parameter range.

9. The hearing device as claimed in claim 7, wherein the second value in the second parameter range is manually changed.

10. The hearing device as claimed in claim 7, wherein the second value in the second parameter device is automatically changed relative to the hearing situation.

11. The hearing device as claimed in claim 7, wherein the second value in the second parameter range is permanently stored in the hearing device.

12. The hearing device as claimed in claim 7, wherein the parameter of the signal processing device is automatically selected relative to the hearing situation.

* * * * *